US005151172A

United States Patent [19]

Kukes et al.

[11] Patent Number: 5,151,172

[45] Date of Patent: Sep. 29, 1992

[54] DISTILLATE HYDROGENATION

[75] Inventors: Simon G. Kukes, Naperville; Frederick T. Clark, Wheaton; P. Donald Hopkins, St. Charles; Lisa M. Green, Geneva, all of Ill.

[73] Assignee: Amoco Corporation, Chicago, Ill.

[21] Appl. No.: 695,426

[22] Filed: May 3, 1991

[51] Int. Cl.[5] ..... C10G 45/12

[52] U.S. Cl. ..... 208/144; 208/143; 208/217; 208/254 H

[58] Field of Search ..... 208/143, 217, 254 H, 208/144

[56] References Cited

U.S. PATENT DOCUMENTS 4,014,783 3/1977 Rausch ..... 208/143

OTHER PUBLICATIONS

Olsen et al, "Unit Processes and Principles of Chemical Engineering", pp. 1-3.

*Primary Examiner*—Theodore Morris
*Assistant Examiner*—William C. Diemler
*Attorney, Agent, or Firm*—Thomas A. Yassen; William H. Magidson; Frank J. Sroka

[57] ABSTRACT

A process and catalyust are provided for hydrogenation of a hydrocarbon feedstock consisting essentially of material boiling between about 150° F. and about 700° F. which comprises reacting the feedstock with hydrogen at hydrogenation conditions in the presence of a catalyst comprising from about 0.1% to about 2.0% by weight each of palladium and platinum and a support comprising mordenite. The process of the present invention provides substantially improved dearomatization performance, increased desulfurization and denitrogenation, increased distillate product cetane number, increased distllate volume expansion, and utilizes a more durable catalyst.

25 Claims, No Drawings

DISTILLATE HYDROGENATION

BACKGROUND OF THE INVENTION

This invention relates to a process and catalyst for reducing the aromatics and olefins content of hydrocarbon distillate products. More particularly, this process relates to an improved catalytic hydrogenation process and catalyst wherein the catalyst comprises platinum and palladium incorporated onto a mordenite support.

For the purpose of the present invention, the term "hydrogenation" is intended to be synonymous with the terms "hydrotreating" and "hydroprocessing," and involves the conversion of hydrocarbons at operating conditions selected to effect a chemical consumption of hydrogen. Included within the processes intended to be encompassed by the term hydrogenation are aromatic hydrogenation, dearomatization, ring-opening, hydrorefining (for nitrogen removal and olefin saturation), and desulfurization (often included in hydrorefining). These processes are all hydrogen-consuming and generally exothermic in nature. For the purpose of the present invention, distillate hydrogenation does not include distillate hydrocracking which is defined as a process wherein at least 15% by weight of the distillate feedstock boiling above 430° F. is converted to products boiling below 430° F.

Petroleum refiners are now facing the scenario of providing distillate fuels, boiling in the range of from about 150° F. to about 700° F., with substantially reduced sulfur and aromatics contents. Sulfur removal is relatively well defined, and at constant pressure and adequate hydrogen supply, is generally a function of catalyst and temperature.

Aromatics removal presents a substantially more difficult challenge. Aromatics removal is generally a function of pressure, temperature, catalyst, and the interaction of these variables on the chemistry and thermodynamic equilibria of the dearomatization reaction. The dearomatization process is further complicated by the wide variances in the aromatics content of the various distillate component streams comprising the hydrogenation process feedstock, the dynamic nature of the flowrates of the various distillate component streams, and the particular mix of mono-aromatics and polycyclic aromatics comprising the distillate component streams.

The criteria for measuring aromatics compliance can pose additional obstacles to aromatics removal processes. The test for measuring aromatics compliance can be, in some regions, the FIA aromatics test (ASTM D1319), which classifies mono-aromatics and polycyclic aromatics equally as "aromatics." Hydrogenation to mono-aromatics is substantially less difficult than saturation of the final ring due to the resonance stabilization of the mono-aromatic ring. Due to these compliance requirements, hydrogenation to mono-aromatics is inadequate. Dearomatization objectives may not be met until a sufficient amount of the polycyclic aromatics and mono-aromatics are fully converted to saturated hydrocarbons.

While dearomatization can require a considerable capital investment on the part of most refiners, dearomatization can provide ancillary benefits. Distillate aromatics content is inextricably related to cetane number, the accepted measure of diesel fuel quality. The cetane number is highly dependent on the paraffinicity of molecular structures, whether they are straight-chain or alkyl attachments to rings. A distillate stream which comprises mostly aromatic rings with few or no alkyl-side chains generally is of lower cetane quality material while a highly paraffinic stream is generally of higher cetane quality.

Dearomatization of refinery distillate streams can increase the volume yield of distillate products. Aromatic distillate components are generally lower in gravity than their similarly boiling paraffinic counterparts. Saturation of aromatic rings can convert these lower API gravity aromatic components to higher API gravity saturated components and expand the volume yield of distillate product.

Dearomatization of refinery distillate streams can also provide increased desulfurization and denitrogenation beyond ordinary levels attendant to distillate hydrogenation processes. Processes for the dearomatization of refinery distillate streams can comprise the construction of a new dearomatization facility, the addition of a second-stage dearomatization step to an existing distillate hydrogenation facility, or other processing options upstream of distillate hydrogenation or at the hydrogenation facility proper. These dearomatization steps can further reduce the nitrogen and sulfur concentrations of the distillate component and product streams, thus reducing desulfurization and denitrogenation catalyst and temperature requirements in existing distillate hydrogenation facilities designed primarily for hydrorefining. Reduced distillate sulfur and nitrogen concentrations can additionally increase the value of these streams for use as blending stocks to sulfur-constrained liquid fuel systems and as fluid catalytic cracking unit (FCC) feed.

While distillate dearomatization can provide cetane number improvement, volume expansion, and additional desulfurization and denitogenation, the process has seldom been attractive in view of the large capital costs and the fact that many refiners have not reached distillate cetane limitations. Now that legislation exists and further legislation is being considered to mandate substantial reductions in distillate aromatics content, the demand for distillate dearomatization processes is now being largely determined by the incentive to continue marketing distillates.

Hydrogenation processes and catalysts for the treatment of distillate streams has been the subject of several patents. U.S. Pat. Nos. 3,736,252, 3,773,654, 3,969,222, 4,014,783, 4,070,272, 4,202,753, 4,610,779, and 4,960,505 are all directed towards processes for hydrogenating and dearomatizing distillate fuels.

The use of mordenite in catalyst supports for hydrogenation has met with limited success and is particularly rare in distillate dearomatization. Mordenite, and zeolite supports in general, have not been commonly used in hydrogenation processes because the silica content, in combination with common commercial hydrogenation metals, such as nickel, molybdenum, and cobalt, can provide lower desulfurization activity, have a tendency to promote undesired cracking reactions, and can be prone to early deactivation.

U.S. Pat. No. 3,197,398 to Young discloses a distillate and gas oil hydrocracking process using a catalyst comprising a group VIII metal (IUPAC) such as palladium on a crystalline alumino-silicate support such as faujasite or mordenite having a silica to alumina molar ratio between about 2.5 and 10 (correlating to a silicon to aluminum atomic ratio of between about 1.25 and 5).

The hydrocracking process and catalyst are designed to convert high-boiling mineral oil feedstocks to lower boiling products such as gasoline. Hydrocracking reactions are not desired in the hydrogenation process and catalyst of the present invention because hydrocracking reduces liquid product yield, increases undesirable light gas make, increases catalyst deactivation rates, and reduces distillate product cetane numbers.

S. M. Kovach and R. A. Kmecak, in a paper entitled "Hydrogenation of Aromatics in the Presence of Sulfur," presented before the Division of Petroleum Chemistry Inc., American Chemical Society, in Houston on Mar. 23–28, 1980, further illustrate the resistance in the art to teach or suggest use of a hydrogenation catalyst comprising hydrogenation metals on a mordenite support for distillate hydrogenation. Kovach and Kmecak teach that palladium on a mordenite support in hydrogenation service readily deactivates, provides poor desulfurization, and exhibits dehydrogenation activity. The catalysts were shown to only tolerate feedstocks having less than 50 ppm sulfur.

The use of metal mixtures on a catalyst support has also been the subject of extensive research. (See P. N. Rylander, Catalytic Hydrogenation over Platinum Metals, Academic Press, New York 1967.) Two platinum metal catalysts, when used together, can give better rates or better yields than either catalyst individually. However, except for certain selected examples, there seems to be no way of predicting when mixtures of catalysts will prove advantageous. A useful guide as to the probable effectiveness of coprecipitated metal catalysts, is the performance of a mechanical mixture of the two metals. (See Rylander, at pages 9–11.)

U.S. Pat. No. 3,943,053 to Kovach et al. discloses a hydrogenation process using a catalyst comprising platinum and palladium on an inert oxide support such as beta, eta, or gamma alumina. The process provides distillate hydrogenation, but with limited dearomatization activity.

It has surprisingly been found that processes having a catalyst incorporating metal mixtures of platinum and palladium onto a support comprising mordenite, result in substantially improved hydrogenation compared to prior art hydrogenation processes including processes having a catalyst incorporating platinum and palladium on inert oxide supports such as alumina. This particular synergy is more profound (in contradistinction to the teachings of Rylander) since physical mixtures of platinum and palladium on a mordenite support have been shown not to provide improved hydrogenation.

It is therefore an object of the present invention to provide a process and catalyst that provide improved distillate dearomatization.

It is an object of the present invention to provide a process and catalyst that provide improved distillate desulfurization and denitrogenation.

It is an object of the present invention to provide a process and catalyst that increase distillate cetane number.

It is an object of the present invention to provide a process and catalyst that expand the volume of the distillate feedstock.

It is yet another object of the present invention to provide a catalyst that has superior crush strength and durability.

Other objects appear herein.

SUMMARY OF THE INVENTION

The above objects can be obtained by providing a process for hydrogenation of a hydrocarbon feedstock consisting essentially of material boiling between about 150° F. and about 700° F. which comprises reacting the feedstock with hydrogen at hydrogenation conditions in the presence of a catalyst comprising from about 0.1% to about 2.0% by weight each of palladium and platinum and a support comprising mordenite.

In another embodiment, the above objects can be obtained by providing a hydrogenation catalyst comprising from about 0.1% to about 2.0% by weight each of palladium and platinum, each incorporated onto a support comprising mordenite. The palladium and platinum are present in a weight ratio ranging from about 5:1 to about 1:2. The mordenite has a silicon to aluminum atomic ratio ranging from about 10 to about 40.

The process and catalyst of the present invention provide significant advantages over comparative processes such as those described in U.S. Pat. No. 3,943,053, which teaches distillate dearomatization using platinum and palladium on an alumina support. The process and catalyst of the present invention provide substantially improved dearomatization performance which permits petroleum refiners to meet future distillate product aromatics constraints at minimum cost.

The process and catalyst of the present invention provide increased desulfurization and denitrogenation over prior art processes. This improved desulfurization and denitrogenation can result in a reduction in first-stage hydrorefining catalyst or temperature requirements, increase the attractiveness of using desulfurized distillate to blend down plant fuel sulfur levels for $SO_2$ environmental compliance, and increase the attractiveness of catalytically cracking desulfurized distillates.

The process and catalyst of the present invention provide increased product cetane numbers over prior art processes. Improved distillate product cetane number can reduce costly cetane improver additive requirements and increase premium (high cetane) distillate production capacity.

The process and catalyst of the present invention provide increased distillate volume expansion to meet customer distillate demands at incrementally lower crude run.

The process and catalyst of the present invention utilize a catalyst having increased durability over prior art processes. A more durable catalyst prolongs catalyst life and reduces catalyst replacement costs.

BRIEF DESCRIPTION OF THE INVENTION

The distillate hydrocarbon feedstock processed in the present invention consists essentially of any one, several, or all refinery streams boiling in a range from about 150° F. to about 700° F., preferably 300° F. to about 700° F., and more preferably between about 350° F. and about 700° F. at atmospheric pressure. For the purpose of the present invention, the term "consisting essentially of" is defined as at least 95% of the feedstock by volume. The lighter hydrocarbon components in the distillate product are generally more profitably recovered to gasoline and the presence of these lower boiling materials in distillate fuels is often constrained by distillate fuel flash point specifications. Heavier hydrocarbon components boiling above 700° F. are generally more profitably processed as FCC Feed and converted to gasoline. The presence of heavy hydrocarbon components in distillate fuels is further constrained by distillate fuel end point specifications.

The distillate hydrocarbon feedstock can comprise high and low sulfur virgin distillates derived from high- and low-sulfur crudes, coker distillates, catalytic cracker light and heavy catalytic cycle oils, and distillate boiling range products from hydrocracker and resid hydrotreater facilities. Generally, coker distillate and the light and heavy catalytic cycle oils are the most highly aromatic feedstock components, ranging as high as 80% by weight (FIA). The majority of coker distillate and cycle oil aromatics are present as mono-aromatics and di-aromatics with a smaller portion present as tri-aromatics. Virgin stocks such as high and low sulfur virgin distillates are lower in aromatics content ranging as high as 20% by weight aromatics (FIA). Generally, the aromatics content of a combined hydrogenation facility feedstock will range from about 5% by weight to about 80% by weight, more typically from about 10% by weight to about 70% by weight, and most typically from about 20% by weight to about 60% by weight. In a distillate hydrogenation facility with limited operating capacity, it is generally profitable to process feedstocks in order of highest aromaticity, since catalytic processes often proceed to equilibrium product aromatics concentrations at sufficient space velocity. In this manner, maximum distillate pool dearomatization is generally achieved.

The distillate hydrocarbon feedstock sulfur concentration is generally a function of the high and low sulfur crude mix, the hydrogenation capacity of a refinery per barrel of crude capacity, and the alternative dispositions of distillate hydrogenation feedstock components. The higher sulfur distillate feedstock components are generally virgin distillate derived from high sulfur crude, coker distillates, and catalytic cycle oils from fluid catalytic cracking units processing relatively higher sulfur feedstocks. These distillate feedstock components can range as high as 2% by weight elemental sulfur but generally range from about 0.1% by weight to about 0.9% by weight elemental sulfur. Where a hydrogenation facility is a two-stage process having a first-stage denitrogenation and desulfurization zone and a second-stage dearomatization zone, the dearomatization zone feedstock sulfur content can range from about 100 ppm to about 0.9% by weight or as low as from about 10 ppm to about 0.9% by weight elemental sulfur.

The distillate hydrocarbon feedstock nitrogen content is also generally a function of the nitrogen content of the crude oil, the hydrogenation capacity of a refinery per barrel of crude capacity, and the alternative dispositions of distillate hydrogenation feedstock components. The higher nitrogen distillate feedstocks are generally coker distillate and the catalytic cycle oils. These distillate feedstock components can have total nitrogen concentrations ranging as high as 2000 ppm, but generally range from about 5 ppm to about 900 ppm.

Where the particular hydrogenation facility is a two-stage process, the first stage is often designed to desulfurize and denitrogenate, and the second stage is designed to dearomatize. In these operations, the feedstocks entering the dearomatization stage are substantially lower in nitrogen and sulfur content and can be lower in aromatics content than the feedstocks entering the hydrogenation facility.

The hydrogenation process of the present invention generally begins with a distillate feedstock preheating step. The feedstock is preheated in feed/effluent heat exchangers prior to entering a furnace for final preheating to a targeted reaction zone inlet temperature. The feedstock can be contacted with a hydrogen stream prior to, during, and/or after preheating. The hydrogen-containing stream can also be added in the hydrogenation reaction zone of a single-stage hydrogenation process or in either the first or second stage of a two-stage hydrogenation process.

The hydrogen stream can be pure hydrogen or can be in admixture with diluents such as hydrocarbon, carbon monoxide, carbon dioxide, nitrogen, water, sulfur compounds, and the like. The hydrogen stream purity should be at least about 50% by volume hydrogen, preferably at least about 65% by volume hydrogen, and more preferably at least about 75% by volume hydrogen for best results. Hydrogen can be supplied from a hydrogen plant, a catalytic reforming facility, or other hydrogen-producing processes.

The reaction zone can consist of one or more fixed bed reactors containing the same or different catalysts. Two-stage processes can be designed with at least one fixed bed reactor for desulfurization and denitrogenation, and at least one fixed bed reactor for dearomatization. A fixed bed reactor can also comprise a plurality of catalyst beds. The plurality of catalyst beds in a single fixed bed reactor can also comprise the same or different catalysts. Where the catalysts are different in a multi-bed fixed bed reactor, the initial bed is generally for desulfurization and denitrogenation, and subsequent beds are for dearomatization.

Since the hydrogenation reaction is generally exothermic, interstage cooling, consisting of heat transfer devices between fixed bed reactors or between catalyst beds in the same reactor shell, can be employed. At least a portion of the heat generated from the hydrogenation process can often be profitably recovered for use in the hydrogenation process. Where this heat recovery option is not available, cooling may be performed through cooling utilities such as cooling water or air, or through use of a hydrogen quench stream injected directly into the reactors. Two-stage processes can provide reduced temperature exotherm per reactor shell and provide better hydrogenation reactor temperature control.

The reaction zone effluent is generally cooled and the effluent stream is directed to a separator device to remove the hydrogen. Some of the recovered hydrogen can be recycled back to the process while some of the hydrogen can be purged to external systems such as plant or refinery fuel. The hydrogen purge rate is often controlled to maintain a minimum hydrogen purity and remove hydrogen sulfide. Recycled hydrogen is generally compressed, supplemented with "make-up" hydrogen, and reinjected into the process for further hydrogenation.

The separator device liquid effluent can then be processed in a stripper device where light hydrocarbons can be removed and directed to more appropriate hydrocarbon pools. The stripper liquid effluent product is then generally conveyed to blending facilities for production of finished distillate products.

Operating conditions to be used in the hydrogenation process of the present invention include an average reaction zone temperature of from about 400° F. to about 750° F., preferably from about 500° F. to about 650° F., and most preferably from about 525° F. to about 625° F. for best results. Reaction temperatures below these ranges can result in less effective hydrogenation. Excessively high temperatures can cause the process to reach a thermodynamic aromatic reduction limit, hydrocracking, catalyst deactivation, and increase energy costs. Desulfurization, in accordance with the process of the present invention, can be less effected by reaction zone temperature than prior art processes, especially at feed sulfur levels below 500 ppm, such as in the second-stage dearomatization zone of a two-stage process.

The process of the present invention generally operates at reaction zone pressures ranging from about 400 psig to about 2000 psig, more preferably from about 500 psig to about 1500 psig, and most preferably from about 600 psig to about 1200 psig for best results. Hydrogen circulation rates generally range from about 500 SCF/Bbl to about 20,000 SCF/Bbl, preferably from about 2,000 SCF/Bbl to about 15,000 SCF/Bbl, and most preferably from about 3,000 to about 13,000 SCF/Bbl for best results. Reaction pressures and hydrogen circulation rates below these ranges can result in higher catalyst deactivation rates resulting in less effective desulfurization, denitrogenation, and dearomatization. Excessively high reaction pressures increase energy and equipment costs and provide diminishing marginal benefits.

The process of the present invention generally operates at a liquid hourly space velocity of from about 0.2 $hr^{-1}$ to about 10.0 $hr^{-1}$, preferably from about 0.5 $hr^{-1}$ to about 3.0 $hr^{-1}$, and most preferably from about 1.0 $hr^{-1}$ to about 2.0 $hr^{-1}$ for best results. Excessively high space velocities will result in reduced overall hydrogenation.

The process and catalyst of the present invention comprise a catalyst having a hydrogenation component and a catalyst support.

The catalyst support component of the present invention comprises mordenite and a refractory inorganic oxide such as silica, alumina, or silica-alumina. The mordenite component is present in the support in an amount ranging from about 10% by weight to about 90% by weight, preferably from about 40% by weight to about 85% by weight, and most preferably from about 50% by weight to about 80% by weight for best results. The refractory inorganic oxide, suitable for use in the present invention, has a pore diameter ranging from about 50 to about 200 Angstroms and more preferably from about 80 to about 150 Angstroms for best results.

Mordenite, as synthesized, is characterized by its silicon to aluminum ratio of about 5:1 and its crystal structure. A typical composition for an assynthesized mordenite is $Na_8Al_8Si_{40}O_{90}.24H_2O$. The structure is one in which the basic building block is a tetrahedron consisting of one silicon or aluminum atom surrounded by four oxygen atoms. The crystal comprises chains of four- and five-membered rings of these tetrahedra which give the structure its stability. The chains are linked together to form a network having a system of large parallel channels interconnected by small cross channels. Rings of 12 tetrahedra form the large channels. Other synthetic zeolites also have such 12-membered rings but have interconnected cages whereas mordenite has uni-dimensional parallel channels of uniform diameter that are not connected. The pore diameter of the mordenite suitable for use in the present invention ranges from about 6.5 to about 7 Angstroms.

For use as the catalyst support of the process and catalyst of the present invention, the sodium form of mordenite is converted to the hydrogen form, which is often referred to as the acid form. Conversion of the sodium form to the hydrogen form can be achieved either by the direct replacement of sodium ions with hydrogen ions or by replacement of sodium ions with ammonium ions followed by decomposition of the ammonium form by calcination. At least about 95% by weight and preferably at least about 99% by weight of the alkali metal is generally removed by the ion-exchange. Chemical analysis of the calcined product of the ammonium form of mordenite generally shows that complete decomposition of the ammonium ion has occurred, yet the X-ray pattern of the product is generally the same as that of the original ammonium form. Thus, no destruction of the crystalline alumino-silicate lattice is detected.

The mordenite of the present invention is generally dealuminized to a silicon to aluminum atomic ratio of from 5:1 to about 50:1, preferably from about 10:1 to about 40:1, and most preferably from about 10:1 to about 30:1 for best results. For purpose of the present invention, a silicon to aluminum atomic ratio of 5 is equivalent to a silica to alumina molar ratio of 10. Silicon to aluminum atomic ratio ranges above 5 generally provide improved sulfur tolerance and deactivation resistance over catalysts having silicon to aluminum atomic ratios below 5. A suitable mordenite for use as a starting material in producing the catalyst of the present invention is CBV-20A, manufactured by Conteka B.V.

Processes for the dealumination of zeolites such as mordenite are well known. Generally, zeolite dealumination is accomplished by chemical methods such as treatments with acids, e.g., HCl, with volatile halides, e.g., $SiCl_4$, or with chelating agents such as ethylenediaminetetraacetic acid (EDTA). Another common technique is a hydrothermal treatment of the mordenite in either pure steam or in air/steam mixtures.

The final calcined catalyst used in the present invention comprises a hydrogenation component consisting essentially of palladium and platinum. These metals can be present in the catalyst in their elemental form or as their oxides, sulfides, or mixtures thereof. The palladium and platinum are each generally present in an amount ranging from about 0.1 percent by weight to about 2.0 percent by weight, preferably from about 0.2 percent by weight to about 1.5 percent by weight, and more preferably from about 0.3 percent by weight to about 1.2 percent by weight based on the total weight of the catalyst and calculated as oxide, for best results. Catalyst metals contents outside of these total metals content ranges can be less economic. Higher metals contents can require more total hydrogenation component due to reduced dispersion and feed/catalyst contact. Lower metals contents can result in increased support material, catalyst handling, transportation, and capital costs.

The weight ratio of elemental palladium to elemental platinum generally ranges from about 10:1 to 1:10, preferably from about 5:1 to 1:2, and more preferably from about 3:1 to 1:1 for best results. Foregoing one of the hydrogenation metals or exceeding the weight ratio ranges generally results in less effective hydrogenation.

The hydrogenation component can be deposed or incorporated upon the support by impregnation employing heat-decomposable salts of platinum and palladium or other methods known to those skilled in the art such as ion-exchange, with impregnation methods being preferred. The platinum and palladium can be impregnated onto the support separately, or can be co-impregnated onto the support. Suitable aqueous impregnation solutions include, but are not limited to, chloroplatinic acid, palladium chloride, tetrammine palladium chloride, and tetrammine platinum chloride.

Impregnation using tetrammine palladium chloride and tetrammine platinum chloride can be performed by precalcining the catalyst support, in the form of a powder, pellets, extrudates, or spheres and determining the amount of water that must be added to wet all of the material. The tetrammine palladium chloride and tetrammine platinum chloride are then dissolved in the calculated amount of water, and the solution added to the support in a manner such that the solution completely saturates the support. The tetrammine palladium chloride and tetrammine platinum chloride are added in a manner such that the aqueous solution contains the total amount of elemental palladium and platinum to be deposited on the given mass of support. Impregnation can be performed for each metal separately, including an intervening drying step between impregnations, or as a single co-impregnation step. The saturated support can then be separated, drained, and dried in preparation for calcining. Commercially, draining volumes can be reduced in order to reduce palladium and platinum losses and waste water handling costs, by providing less than the full amount of aqueous solution (such as from 90% to 100% by volume of aqueous solution) necessary to saturate all of the support. Calcination generally is performed at a temperature of from about 932° F. to about 1202° F., or more preferably from about 977° F. to about 1067° F.

The finished hydrogenation catalyst should be durable and resilient to conditions encountered in typical petroleum refineries. Catalyst durability is commonly measured by crush strength. The crushing strength of the catalyst is determined by placing a catalyst pill on its side between two parallel, horizontal flat plates, one stationary and one movable. A gradually increasing force is applied to the movable plate, perpendicular to the surface of the plate, until the pill breaks. The crushing strength for purpose of the present invention is the force, in pounds, applied at the instant of pill breakage divided by the length of the particular extrudate particle in millimeters. The reported crushing strength is generally the average value determined on 100 pills. The hydrogenation catalyst suitable for use in the present invention should have a crush strength for cylinder extrudate particles of 1/16 inches, of greater than 0.1 lb/mm, preferably greater than 0.2 lb/mm, and more preferably greater than 0.4 lb/mm for best results. High catalyst crush strengths can reduce catalyst attrition and replacement costs.

The process and catalyst of the present invention comprising hydrogenation of a distillate boiling range feedstock utilizing a catalyst comprising palladium and platinum and a support comprising mordenite provides superior dearomatization performance. Dearomatization performance is generally measured by the percentage of aromatics saturated, calculated as the weight percentage of aromatics in the hydrogenation process product subtracted from the weight percentage of aromatics in the feedstock divided by the weight percentage of aromatics in the feedstock. The hydrogenation process in accordance with the principles of the present invention can generally attain and sustain aromatics saturation levels of greater than 15 percent, greater than 35 percent, and as high as or higher than 70 percent. This high level of aromatics saturation provides for a hydrogenation process that can operate at less severe and costly operating conditions, prolonging catalyst life.

The hydrogenation process and catalyst of the present invention provide outstanding desulfurization and denitrogenation performance. The hydrogenation process in accordance with the principles of the present invention can generally attain product sulfur levels below 250 ppm, below 150 ppm, and below 60 ppm. The hydrogenation process in accordance with the principles of the present invention can generally attain product nitrogen levels below 50 ppm, below 20 ppm, and below 10 ppm. This level of desulfurization and denitrogenation can result in a reduction in first-stage hydrorefining catalyst requirements, increase the attractiveness of using desulfurized distillate to blend down plant fuel sulfur levels for $SO_2$ environmental compliance, and increase the attractiveness of catalytically cracking desulfurized distillates.

The hydrogenation process and catalyst of the present invention provide a substantial increase in distillate product cetane number. Higher fluid catalytic cracking severity has resulted in FCC distillate products having lower cetane numbers, adding cetane limitations in refinery distillate pools that previously may not have existed. The hydrogenation process in accordance with the principles of the present invention can generally achieve product cetane number improvements of over 3 numbers, over 6 numbers, and over 10 numbers. Improved cetane production can reduce costly cetane improver additive requirements and increase premium (high cetane) distillate production capacity.

The hydrogenation process and catalyst of the present invention provide substantial distillate volume expansion. Distillate volume expansion is generally measured by the reduction in specific gravity across the hydrogenation process and is calculated as the specific gravity of the hydrogenation process product substracted from the specific gravity of the feedstock divided by the specific gravity of the feedstock. The hydrogenation process in accordance with the principles of the present invention can expand the volume of the distillate feedstock by more than 2 percent, more than 3 percent, and more than 6 percent. Volume expansion across a distillate hydrogenation process can permit petroleum refiners to meet customer distillate demands at incrementally lower crude run.

The hydrogenation catalyst of the present invention has outstanding durability. The hydrogenation catalyst used in the process of the present invention has a crush strength generally exceeding that utilized in prior art processes. A more durable hydrogenation catalyst prolongs catalyst life and reduces catalyst replacement costs.

The present invention is described in further detail in connection with the following examples, it being understood that the same are for purposes of illustration and not limitation.

EXAMPLE 1

A hydrogenation catalyst support was prepared by mixing mordenite having a silicon to aluminum atomic ratio of about 11.5:1 (CBV-20A, manufactured by Conteka B. V.) with gamma alumina sol to provide a support mixture containing 60% by weight mordenite and 40% by weight dry alumina. The mixture was dried for 12 hours at 248° F.

The hydrogenation catalyst support was extruded into 1/16 inch extrudates and dried for 12 hours at 248° F. The support was calcined at 1000° F. for 3 hours.

EXAMPLE 2

A hydrogenation catalyst was prepared using the dehydrogenation catalyst support from Example 1. The amount of water required to saturate and fill the pores of the support was determined, and an aqueous impregnation solution was prepared with this amount of water and a sufficient amount of tetrammine palladium chloride to provide a dehydrogenation catalyst having 0.5 wt % elemental palladium. The hydrogenation catalyst was dried for 12 hours at 248° F. and calcined at 1000° F. for 3 hours. The catalyst was designated as Catalyst 2 and the composition and properties of the catalyst are specified in Table II.

EXAMPLE 3

A hydrogenation catalyst was prepared in a manner similar to that described in Example 2. The hydrogenation catalyst was co-impregnated with an aqueous solution of a sufficient amount of tetrammine palladium chloride and tetrammine platinum chloride in water to provide a hydrogenation catalyst having 0.35 wt % elemental palladium and 0.15 wt % elemental platinum. The hydrogenation catalyst was dried for 12 hours at 248° F. and calcined at 1000° F. for 3 hours. The crush strength of the catalyst was determined to be 1.35 lb/mm. The catalyst was designated as Catalyst 3 and the composition and properties of the catalyst are specified in Table II.

EXAMPLE 4

A hydrogenation catalyst was prepared in a manner similar to that described in Example 2. The hydrogenation catalyst was co-impregnated with an aqueous solution of a sufficient amount of tetrammine palladium chloride and tetrammine platinum chloride in water to provide a hydrogenation catalyst having 0.25 wt % elemental palladium and 0.25 wt % elemental platinum. The hydrogenation catalyst was dried for 12 hours at 248° F. and calcined at 1000° F. for 3 hours. The catalyst was designated as Catalyst 4 and the composition and properties of the catalyst are specified in Table II.

EXAMPLE 5

A hydrogenation catalyst was prepared in a manner similar to that described in Example 2. The hydrogenation catalyst was co-impregnated with an aqueous solution of a sufficient amount of tetrammine palladium chloride and tetrammine platinum chloride in water to provide a hydrogenation catalyst having 0.15 wt % elemental palladium and 0.35 wt % elemental platinum. The hydrogenation catalyst was dried for 12 hours at 248° F. and calcined at 1000° F. for 3 hours. The catalyst was designated as Catalyst 5 and the composition and properties of the catalyst are specified in Table II.

EXAMPLE 6

A hydrogenation catalyst was prepared in a manner similar to that described in Example 2. The hydrogenation catalyst was impregnated with an aqueous solution of a sufficient amount of tetrammine platinum chloride in water to provide a hydrogenation catalyst having 0.5 wt % elemental platinum. The hydrogenation catalyst was dried for 12 hours at 248° F. and calcined at 1000° F. for 3 hours. The catalyst was designated as Catalyst 6 and the composition and properties of the catalyst are specified in Table II.

EXAMPLE 7

A hydrogenation catalyst was prepared as a 50%/50% physical mixture of the hydrogenation catalysts of Examples 2 and 6. The catalyst was designated as Catalyst 7 and the composition and properties of the catalyst are specified in Table II.

EXAMPLE 8

A feedstock consisting of hydrogenated light catalytic cycle oil was prepared from light catalytic cycle oil obtained from the Amoco Oil Texas City Refinery. The light catalytic cycle oil was hydrotreated in a high-pressure trickle-bed unit at a pressure of 300 psig and a temperature of 600° F., to a sulfur level of 378 ppm. The hydrotreated light catalytic cycle oil properties are described in Table I.

TABLE 1

| FEEDSTOCK PROPERTIES | |
|---|---|
| API Gravity | 24.0 |
| Mass Spec Analysis, wt %* | |
| Saturates | 33.2 |
| Aromatics | 66.8 |
| Mono- | 37.9 |
| Di- | 24.6 |
| Tri- | 4.3 |
| FIA Aromatics (ASTM D 1319) | 62.0 |
| Elemental Analysis (ASTM C-730) | |
| Carbon, wt % | 88.75 |
| Hydrogen, wt % | 11.06 |
| Sulfur, ppm | 378 |
| Nitrogen, ppm | 165 |
| H/C, Mole Ratio | 1.48 |
| Cetane Number (calc.) | 31.2 |

*Published in Analytical Chemistry, 43(11), pages 1425-1434 (1971)

EXAMPLE 9

The feedstock of Example 8 was hydrogenated over the catalysts produced in Examples 2 through 7. Catalyst performance was evaluated using a bench scale, isothermal reactor having a ¾-inch internal diameter and a thermowell. Operation was downflow with once-through hydrogen and oil. Each catalyst was used in the form of 1/16-inch extrudates and each catalyst charge was approximately 20 g. The catalyst was supported near the center of the reactor on a layer of 3 mm Pyrex glass beads, and a preheat zone of 5 mm beads was provided above the catalyst bed.

Each catalyst was pretreated prior to testing by injecting hydrogen through the reactor at a flowrate of 0.6 SCFH for 2 hours. Reactor conditions were maintained at 600° F. and 1200 psig during the pretreatment step.

Operating conditions for the runs were approximately a pressure of 1200 psig, a temperature of 600° F., an hourly space velocity ($WHSV^{-1}$) $1.0^{-1}$, and a hydrogen injection rate of 4000 SCF/Bbl.

Over each 24-hour period, at least a 6-hour sample of product was collected in a nitrogen-purged receptacle. Nitrogen purging was performed to remove hydrogen sulfide. The product was analyzed for API gravity, sulfur content (elemental) by X-ray fluorescence, nitrogen content, aromatics content by Mass Spec. Analysis as published in *Analytic Chemistry*, 43(11), pages 1425-1434 (1971), and hydrogen to carbon ratio. Process and product calculations were performed to measure percent aromatics saturation, percent volume expansion, and product cetane number. The cetane number was provided by an empirical correlation which determines cetane number from product properties such as API gravity and the boiling point temperature at which 50 vol % of the distillate feed or product stream is vaporized.

The catalyst composition, process conditions, product properties, and process calculations for each of the catalysts described in Examples 2 through 7 are specified in Table II.

Catalyst 2, having 0.5 wt % palladium and no platinum on a support comprising mordenite having a silicon to aluminum atomic ratio of 11.5:1, provided poor dearomatization performance and average desulfurization, volume expansion, and cetane number improvement. Denitrogenation performance was above average.

Catalyst 3, having 0.35 wt % palladium and 0.15 wt % platinum on a support comprising mordenite having a silicon aluminum atomic ratio of 11.5:1, provided superior dearomatization performance, volume expansion, cetane number improvement, and desulfurization. Denitrogenation performance was also outstanding.

Catalyst 4, having 0.25 wt % palladium and 0.25 wt % platinum on a support comprising mordenite having a silicon to aluminum atomic ratio of 11.5:1, provided outstanding dearomatization performance, volume expansion, cetane number improvement, desulfurization, and denitrogenation. Dearomatization, volume expansion, and cetane number improvement performance were not as good as Catalyst 3, while desulfurization and denitrogenation performance were superior to Catalyst 3.

Catalyst 5, having 0.15 wt % palladium and 0.35 wt % platinum on a support comprising mordenite having a silicon to aluminum atomic ratio of 11.5:1, provided outstanding denitrogenation, volume expansion, and cetane number improvement performance. Dearomatization and desulfurization performance was above average. Overall, Catalyst 5 was less effected than Catalysts 3 and 4.

Catalyst 6, having no palladium and 0.5 wt % platinum on a support comprising mordenite having a silicon to aluminum atomic ratio of 11.5:1, provided poor dearomatization and average volume expansion, cetane number improvement and desulfurization. Denitrogenation performance was above average. Overall, Catalyst 6 was less effective than Catalysts 3, 4 and 5, and performed similarly to Catalyst 2.

Catalyst 7, consisting of a physical mixture of 0.25 wt % palladium and 0.25 wt % platinum on a support comprising mordenite having a silicon to aluminum atomic ratio of 11.5:1 provided poor dearomatization performance, volume expansion, cetane number improvement, desulfurization, and denitrogenation. While Catalyst 4, having the same concentrations of palladium and platinum metals incorporated into the catalyst, provided outstanding performance, a physical mixture of palladium- and platinum-containing catalysts, as provided in Catalyst 7, provided surprisingly poor performance.

TABLE 2

| | DISTILLATE DEAROMATIZATION | | | | | | | | | | | | |
|---|---|---|---|---|---|---|---|---|---|---|---|---|---|
| | CATALYST | | | | | | | | | | | | |
| | 2 | 3 | 4 | 5 | 6 | 7 | 10 | 11 | 12 | 13 | 14 | 16 | 17 |
| CATALYST COMPOSITION | | | | | | | | | | | | | |
| SUPPORT MATERIAL | Mord. | Mord. | Mord. | Mord. | Mord. | Mord. | Alum. | Alum. | Alum. | Alum. | Alum. | Mord. | Mord. |
| MORD. SILICON TO ALUMINUM ATOMIC RATIO | 11:5:1 | 11:5:1 | 11:5:1 | 11:5:1 | 11:5:1 | 11:5:1 | N/A | N/A | N/A | N/A | N/A | 23.6:1 | 7.4:1 |
| PALLADIUM, Wt % | 0.50 | 0.35 | 0.25 | 0.15 | 0.00 | 0.25* | 0.30 | 0.20 | 0.10 | 0.00 | 0.35 | 0.25 | 0.25 |
| PLATINUM, Wt % | 0.00 | 0.15 | 0.25 | 0.35 | 0.50 | 0.25* | 0.00 | 0.10 | 0.20 | 0.30 | 0.15 | 0.25 | 0.25 |
| PROCESS CONDITIONS | | | | | | | | | | | | | |
| TEMPERATURE, °F. | 600 | 600 | 600 | 600 | 600 | 600 | 600 | 600 | 600 | 600 | 600 | 600 | 600 |
| PRESSURE, PSIG | 1200 | 1200 | 1200 | 1200 | 1200 | 1200 | 1200 | 1200 | 1200 | 1200 | 1200 | 1200 | 1200 |
| HYDROGEN RATE, SCF/Bbl | 4000 | 4000 | 4000 | 4000 | 4000 | 4000 | 4000 | 4000 | 4000 | 4000 | 4000 | 4000 | 4000 |
| WHSV$^{-1}$ | 1.0 | 1.0 | 1.0 | 1.0 | 1.0 | 1.0 | 1.0 | 1.0 | 1.0 | 1.0 | 1.0 | 1.0 | 1.0 |
| PRODUCT PROPERTIES AND PROCESS CALCULATIONS | | | | | | | | | | | | | |
| API GRAVITY | 28.9 | 37.2 | 35.1 | 34.7 | 29.2 | 28.0 | 25.7 | 27.9 | 27.8 | 25.1 | 28.2 | 36.8 | 32.8 |
| SULFUR, PPM | 109 | 51 | 37 | 58 | 55 | 143 | 175 | 115 | 113 | 215 | 12 | 128 | 86 |
| NITROGEN, PPM | 5 | 9 | 2 | 3 | 3 | 24 | 58 | 46 | 30 | 39 | 17 | 13 | 5 |
| AROMATICS, Wt % | 56.3 | 17.6 | 34.0 | 40.1 | 53.8 | 16.5 | 62.0 | 49.0 | 50.0 | 65.0 | 46.4 | 31.5 | 37.1 |
| % AROMATIC SATURATION | 16 | 74 | 49 | 49 | 19 | 16 | 7 | 27 | 25 | 2 | 30 | 53 | 44 |
| H/C RATIO, MOLE | 1.64 | 1.83 | 1.78 | 1.72 | 1.65 | 1.62 | 1.59 | 1.67 | 1.65 | 1.56 | 1.67 | 1.77 | 1.72 |
| VOLUME EXPANSION, % | 3.1 | 7.8 | 6.7 | 6.4 | 3.2 | 2.5 | 1.1 | 2.4 | 2.4 | 0.7 | 2.6 | 7.6 | 5.4 |
| CETANE NUMBER, CALC. | 37.9 | 51.0 | 47.5 | 46.8 | 38.4 | 36.6 | 33.5 | 36.5 | 36.4 | 32.7 | 36.9 | 40.8 | 43.8 |
| CRUSH STRENGTH, lb/mm | | 1.35 | | | | | | | | | 0.35 | | |

*PHYSICAL MIXTURE OF Pd/Pt

EXAMPLE 10

Comparative hydrogenation catalysts were prepared for comparison with the hydrogenation catalysts of the present invention (Examples 10-14).

Gamma alumina was extruded into 1/16-inch extrudates, dried at 248° F. for 12 hours, and calcined at 1000° F. for 10 hours. The amount of water required to saturate and fill the pores of the support was determined and an aqueous impregnation solution was prepared with this amount of water and a sufficient amount of tetrammine palladium chloride to provide a hydrogenation catalyst having 0.3 wt % elemental palladium. The hydrogenation catalyst was dried for 12 hours at 248° F. and calcined at 1000° F. for 4 hours. The catalyst was designated as Catalyst 10 and the composition and properties of the catalyst are specified in Table II.

EXAMPLE 11

Gamma alumina was extruded into 1/16-inch extrudates, dried at 248° F. for 12 hours, and calcined at 1000° F. for 10 hours. The hydrogenation catalyst was impregnated with an aqueous solution of a sufficient amount of tetrammine platinum chloride in water to provide a hydrogenation catalyst having 0.2 wt % elemental platinum. The hydrogenation catalyst was dried for 12 hours at 248° F. The hydrogenation catalyst was then impregnated with an aqueous solution of a sufficient amount of tetrammine palladium chloride in water to provide a hydrogenation catalyst having 0.1 weight percent elemental palladium. The dehydrogenation catalyst was dried for 12 hours at 248° F. and calcined at 1000° F. for 4 hours. The catalyst was designated as Catalyst 11 and the composition and properties of the catalyst are specified in Table II.

EXAMPLE 12

Gamma alumina was extruded into 1/16-inch extrudates, dried at 248° F. for 12 hours, and calcined at 1000° F. for 10 hours. The hydrogenation catalyst was impregnated with an aqueous solution of a sufficient amount of tetrammine platinum chloride in water to provide a hydrogenation catalyst having 0.2 wt % elemental platinum. The hydrogenation catalyst was dried for 12 hours at 248° F. The hydrogenation calalyst was then impregnated with an aqueous solution of a sufficient amount kof tetrammine palladium chloride in water to provide a hydrogenation catalyst having 0.1 weight percent elemental palladium. The dehydrogenation catalyst was dried for 12 hours at 248° F. and calcined at 1000° F. for 4 hours. The catalyst was designated as Catalyst 12 and the composition and properties of the catalyst are specified in Table II.

EXAMPLE 13

Gamma alumina was extruded into 1/16-inch extrudates, dried at 248° F. for 12 hours, and calcined at 1000° F. for 10 hours. The hydrogenation catalyst was impregnated with an aqueous solution of a sufficient amount of tetrammine platinum chloride in water to provide a hydrogenation catalyst having 0.3 wt % elemental platinum. The hydrogenation catalyst was dried for 12 hours at 248° F. and calcined at 1000° F. for 4 hours. The catalyst was designated as Catalyst 13 and the composition and properties of the catalyst are specified in Table II.

EXAMPLE 14

Gamma alumina was extruded into 1/16-inch extrudates, dried at 248° F. for 12 hours, and calcined at 1000° F. for 10 hours. The hydrogenation catalyst was co-impregnated with an aqueous solution of a sufficient amount of tetrammine palladium chloride and tetrammine platinum chloride in water to provide a hydrogenation catalyst having 0.35 wt % elemental palladium and 0.15 wt % elemental platinum. The hydrogenation catalyst was dried for 12 hours at 248° F. and calcined at 1000° F. for 4 hours. The crush strength of the catalyst was determined to be 0.35 lb/mm. The catalyst was designated as Catalyst 14 and the composition and properties of the catalyst are specified in Table II.

EXAMPLE 15

The feedstock of Example 8 was hydrogenated over the comparative catlysts described in Examples 10 through 14 in a manner similar to that described in Example 9. The catalyst composition, process conditions, product properties, and process calculations for each of the catalysts described in Examples 10 through 14 are specified in Table II.

Catalyst 10, having 0.3 wt % palladium and no platinum on an alumina support, provided poor dearomatization performance, volume expansion, cetane number improvement, desulfurization, and denitrogenation. Catalysts 2 through 7 having a support comprising mordenite all provided performance superior to that of Catalyst 10.

Catalyst 11, having 0.2 wt % palladium and 0.1 wt % platinum on an alumina support, provided poor dearomatization performance, volume expansion, cetane number improvement, desulfurization, and denitrogenation. While Catalyst 11 provided generally better performance than Catalyst 10, Catalysts 2 through 7 having a support comprising mordenite all provided performance superior to that of Catalyst 11.

Catalyst12, having 0.1 wt. % palladium and 0.2 wt. % platinum on an alumina support, provided poor dearomatization performance, volume expansion, cetane number improvement, desulfurization, and denitrogenation. Catalyst 12 provided generally better performance than Catalyst 10 and similar performance to Catalyst 11. Catalysts 2 through 7 having a support comprising mordenite all provided performance superior to that of Catalyst 12.

Catalyst 13, having no palladium and 0.3 wt. % on an alumina support, provided poor dearomatization performance, volume expansion, cetane number improvement, desulfurization, and denitrogenation. Catalyst 13 was less effective than Catalysts 11 and 12 and provided performance similar to that of Catalyst 11. Catalysts 2 through 7 having a support comprising mordenite all provided performance superior to that of Catalyst 13.

Catalyst 14, having 0.35 wt % palladium and 0.15 wt. % platinum on an alumina support, provided average dearomatization, volume expansion, cetane number improvement, and denitrogenation. Desulfurization performance was superior. Catalyst 14, having a higher percentage of hydrogenation metals than Catalysts 10 through 13 and a similar percentage of hydrogenation metals to Catalysts 2 through 7, provided improved overall performance over Catalysts 10 through 13. Catalysts 3 through 5, comprising mordenite provided superior performance to Catalyst 14. Catalysts 2 and 6, comprising mordenite and only one hydrogenation metal, provided overall performance similar to that of Catalyst 14. Catalyst 7, comprising a physical mixture of catalysts containing palladium and platinum independently on a mordenite support, provided less effective overall hydrogenation.

Catalyst 14, compared directly with Catalyst 3, having the same concentrations of each metal hydrogenation component, was clearly less effective. Catalyst 3, comprising mordenite, provided superior dearomatization performance, volume expansion, cetane number improvement, and denitrogenation. Catalyst 14 provided slightly better desulfurization. Moreover, Catalyst 3 comprising mordenite, had a substantially higher crush strength than Catalyst 14 having an alumina support.

EXAMPLE 16

A hydrogenation catalyst was prepared by mixing mordenite having a high silicon to aluminum atomic ratio of about 23.6:1 (CBV-30A, manufactured by Conteka B.V.) with gamma alumina sol to provide a support mixture containing 60% by weight mordenite and 40% by weight dry alumina. The mixture was dried for 12 hours at 248° F. The hydrogenation catalyst support was extruded into 1/16-inch extrudates and dried for 12 hours at 248° F. The support was calcined at 1000° F. for 3 hours.

The hydrogenation catalyst was co-impregnated with an aqueous solution of a sufficient amount of tetrammine palladium chloride and tetrammine platinum chloride in water to provide a hydrogenation catalyst having 0.25 wt % elemental palladium and 0.25 wt % elemental platinum. The hydrogenation catalyst was dried for 12 hours at 248° F. and calcined at 1000° F. for 3 hours. The catalyst was designated as Catalyst 16 and the composition and properties of the catalyst are specified in Table II.

EXAMPLE 17

A hydrogenation catalyst was prepared by mixing mordenite having a low silicon to aluminum atomic ratio of about 7.4:1 (CBV-10A, manufactured by Conteka B.V.) with gamma alumina sol to provide a support mixture containing 60% by weight mordenite and 40% by weight dry alumina. The CBV-10A mordenite was in the sodium form and was exchanged three times with ammonium nitrate solution (1 part ammonium nitrate, 10 parts water, and 1 part CBV-10A by weight) at room temperature before being made into the catalyst. The mixture was dried for 12 hours at 248° F. The hydrogenation catalyst support was extruded into 1/16-inch extrudates and dried for 12 hours at 248° F. The support was calcined at 1000° F. for 3 hours.

The hydrogenation catalyst was co-impregnated with an aqueous solution of a sufficient amount of tetrammine palladium chloride and tetrammine platinum chloride in water to provide a hydrogenation catalyst having 0.25 wt % elemental palladium and 0.25 wt % elemental platinum. The hydrogenation catalyst was dried for 12 hours at 248° F. and calcined at 1000° F. for 3 hours. The catalyst was designated as Catalyst 17 and the composition and properties of the catalyst are specified in Table II.

EXAMPLE 18

The feedstock of Example 8 was hydrogenated over the catalysts having high and low silicon to aluminum atomic ratios described in Examples 16 and 17 in a manner similar to that described in Example 9. The catalyst composition, process conditions, product properties, and process calculations for each of the catalysts described in Examples 16 and 17 are specified in Table II.

Catalyst 16, having 0.25 wt % palladium and 0.25 wt % platinum on a mordenite support having a silicon to aluminum atomic ratio of 23.6:1, provided superior dearomatization and volume expansion and above average cetane number improvement and denitrogenation. Desulfurization performance was below average. Catalysts having high silicon to aluminum atomic ratios are particularly desirable in two-stage hydrogenation processes having a first-stage desulfurization and denitrogenation zone.

Catalyst 16, having the same concentration of each metal hydrogenation component as Catalyst 4 and a higher silicon to aluminum atomic ratio of 23.6:1, provided slightly improved dearomatization performance and volume expansion over Catalyst 4 having a lower silicon to aluminum atomic ratio. Catalyst 4 provided better cetane number improvement, desulfurization, and denitrogenation than Catalyst 16 having a higher silicon to aluminum atomic ratio.

Catalyst 17, having 0.25 wt % palladium and 0.25 wt % platinum on a mordenite support having a silicon to aluminum atomic ratio of 7.4:1, provided superior denitrogenation and cetane number improvement and above average dearomatization performance and volume expansion. Desulfurization performance was average.

Catalyst 17, having the same concentration of each metal hydrogenation component as Catalyst 4 and a lower silicon to aluminum atomic ratio of 7.4:1, was less effective than the higher silicon to aluminum atomic ratio catalyst. Dearomatization performance, volume expansion, cetane number improvement, desulfurization, and denitrogenation were all reduced at the lower silicon to aluminum atomic ratio of Catalyst 17.

That which is claimed is:

1. A process for hydrogenation of a hydrocarbon feedstock consisting essentially of material boiling between about 150° F. and about 700° F. which comprises reacting said feedstock with hydrogen at hydrogenation conditions in the presence of a catalyst comprising from about 0.1% to about 2.0% by weight each of palladium and platinum and a support comprising mordenite.

2. The process of claim 1 wherein said support comprises from about 40% to about 85% by weight mordenite.

3. The process of claim 1 wherein said support comprises alumina.

4. The process of claim 1 wherein said mordenite has a silicon to aluminum atomic ratio ranging from about 10 to about 40.

5. The process of claim 1 wherein said palladium and said platinum are present in a weight ratio ranging from about 5:1 to about 1:2.

6. The process of claim 1 wherein said hydrocarbon feedstock comprises from about 20 weight percent to about 60 weight percent aromatics, from about 10 ppm to about 0.9 weight percent elemental sulfur, and from about 5 ppm to about 900 ppm nitrogen.

7. The process of claim 1 wherein said hydrocarbon feedstock comprises at least one member selected from the group consisting of light catalytic cycle oils, heavy catalytic cycle oils, coker distillates, virgin distillates, hydrocracker distillates, and resid hydrotreater distillates.

8. The process of claim 1 wherein said hydrogenation conditions comprise a reaction temperature of from about 500° F. to about 650° F., a reaction pressure of from about 500 psig to about 1500 psig, a liquid hourly space velocity of from about 0.5 $hr^{-1}$ to about 3.0 $hr^{-1}$, and a hydrogen injection rate of from about 2000 SCF/Bbl to about 15000 SCF/Bbl.

9. A process for hydrogenation of a hydrocarbon feedstock consisting essentially of material boiling between about 150° F. and about 700° F. which comprises reacting said feedstock with hydrogen at hydrogenation conditions, wherein said hydrogenation conditions comprise a reaction temperature of from about 400° F. to about 750° F., and a reaction pressure of from about 400 psig to about 2,000 psig, in the presence of a catalyst comprising from about 0.1% to about 2.0% by weight each of palladium and platinum, each incorporated onto a support comprising mordenite, said mordenite having a silicon to aluminum atomic ratio ranging from about 10 to about 40.

10. The process of claim 9 wherein said support comprises from about 40% to about 85% by weight mordenite.

11. The process of claim 10 wherein said support comprises alumina.

12. The process of claim 9 wherein said mordenite has a silicon to aluminum atomic ratio ranging from about 10 to about 30.

13. The process of claim 9 wherein said palladium and said platinum are present in a weight ratio ranging from about 5:1 to about 1:2.

14. The process of claim 9 wherein said hydrocarbon feedstock comprises from about 20 weight percent to about 60 weight percent aromatics, from about 10 ppm to about 0.9 weight percent elemental sulfur, and from about 5 ppm to about 900 ppm nitrogen.

15. The process of claim 9 wherein said hydrocarbon feedstock comprises at least one member selected from the group consisting of light catalytic cycle oil, heavy catalytic cycle oil, coker distillate, and virgin distillates.

16. The process of claim 9 wherein said hydrogenation conditions comprise a reaction temperature of from about 525° F. to about 625° F., a reaction pressure of from about 600 psig to about 1200 psig, a liquid hourly space velocity of from about 1.0 $hr^{-1}$ to about 2.0 $hr^{-1}$, and a hydrogen, wherein said hydrogenation conditions comprise a reaction temperature of from about 400° F. to about 750° F., and a reaction pressure of from about 400 psig to about 2,000 psig, injection rate of from about 3000 SCF/Bbl to about 13000 SCF/Bbl.

17. A process for hydrogenation of a hydrocarbon feedstock consisting essentially of material boiling between about 300° F. and about 700° F. which comprises reacting said feedstock with hydrogen at hydrogenation conditions in the presence of a catalyst and producing a product, said catalyst comprising from about 0.1% to about 2.0% by weight each of palladium and platinum, each incorporated onto a support comprising mordenite, said palladium and platinum present in a weight ratio ranging from about 5:1 to about 1:2 and said mordenite having a silicon to aluminum atomic ratio ranging from about 10 to about 40.

18. The process of claim 17 wherein said support comprises from about 50% to about 80% by weight mordenite.

19. The process of claim 18 wherein said support comprises alumina.

20. The process of claim 17 wherein said mordenite has a silicon to aluminum atomic ratio ranging from about 10 to about 30.

21. The process of claim 17 wherein said palladium and said platinum are present in a weight ratio ranging from about 3:1 to about 1:1.

22. The process of claim 17 wherein said hydrogenation process aromatic saturation level is greater than 35 percent.

23. The process of claim 17 wherein said product of said process for hydrogenation has a cetane number 6 numbers higher than said feedstock.

24. The process of claim 17 wherein the volume of said product of said process for hydrogenation increases by at least 3 percent.

25. The process of claim 17 wherein the crush strength of said catalyst is at least 0.4 lb/mm.

* * * * *

UNITED STATES PATENT OFFICE
CERTIFICATE OF CORRECTION

'atent No. 5,151,172 Dated September 29, 1992 nventor(s) Simon G. Kukes, Frederick T. Clark, P. Donald Hopkins, Lisa M. Green

It is certified that error appears in the above-identified patent ınd that said Letters Patent is hereby corrected as shown below:

'atent reads:

| Col. | Line | |
|---|---|---|
| 4 | 9 | "less effected" should be --less effective-- |
| 5 | 26 | "having 0.2 wt%" should be --having 0.1 wt%-- |
| 5 | 31 | "having 0.1 weight" should be --having 0.2 weight-- |
| 5 | 48 | "amount kof tetrammine" should be -- amount of tetrammine-- |
| 0 | 3-6 | "and a hydrogen. wherein said hydrogenation conditions comprise a reaction temperature of from about 400°F to about 750°F and a reaction pressure of from about 400 psig to about 2,000 psig. injection rate of" should be --and a hydrogen injection rate of-- |
| 0 | 11-12 | "hydrogenation conditions in the presence of a catalyst" should be --hydrogenation conditions, wherein said hydrogenation conditions comprise a reaction temperature of from about 400°F to about 750°F, and a reaction pressure of from about 400 psig to about 2,000 psig, in the presence of a catalyst-- |

Signed and Sealed this

Twenty-eighth Day of September, 1993

*Attest:*

*Attesting Officer*

BRUCE LEHMAN

*Commissioner of Patents and Trademarks*